US005208510A

United States Patent [19]

Grocki

[11] Patent Number: 5,208,510

[45] Date of Patent: May 4, 1993

[54] CRT MAGNETIC FIELD CANCELLING DEVICE

[75] Inventor: Wayne D. Grocki, Libertyville, Ill.

[73] Assignee: Zenith Electronics Corporation, Glenview, Ill.

[21] Appl. No.: 814,125

[22] Filed: Dec. 30, 1991

[51] Int. Cl.[5] ..... H01J 5/02

[52] U.S. Cl. ..... 315/85; 361/146

[58] Field of Search ..... 315/8, 85; 361/146, 361/150

[56] References Cited

U.S. PATENT DOCUMENTS 4,709,220 11/1987 Sakane ..... 335/214
4,943,753 7/1990 Hevesi ..... 313/440
4,992,697 2/1991 Penninga et al. ..... 315/8 X

FOREIGN PATENT DOCUMENTS 0218961 4/1987 European Pat. Off. ..... 315/8

OTHER PUBLICATIONS

Test Methods for Visual Display Units, MPR 1990:8 1990-12-01 IEEE Working Group P-1140 on Standard for Measurement of Electromagnetic Near Fields (5HZ -30MHz) Nov. 9, 1990.

*Primary Examiner*—David Mis

[57] ABSTRACT

A stray magnetic field cancelling device for a cathode ray tube comprises an elongated member of adjustable length composed of at least two magnetizable metal plates in slidable relationship enveloped by an electromagnetic coil. The device is physically isolated from the yoke a distance effective to exert minimum effect on the yoke deflection fields. Also, the device is oriented transversely to the centerline of the cathode ray tube so as to generate a cancelling magnetic field in opposed relationship with, and transverse to, the stray magnetic field. A simple mechanical adjustment provides for adapting the device to CRTs of varying sizes.

18 Claims, 3 Drawing Sheets

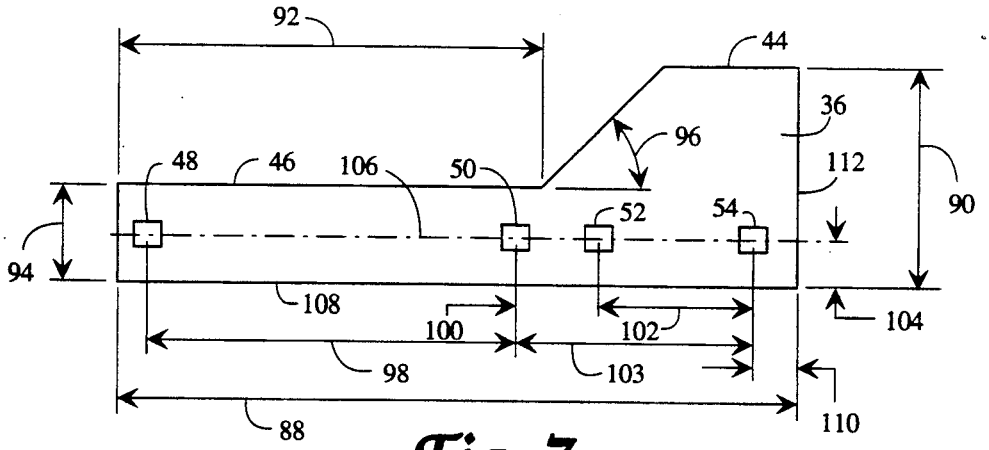
Fig. 7
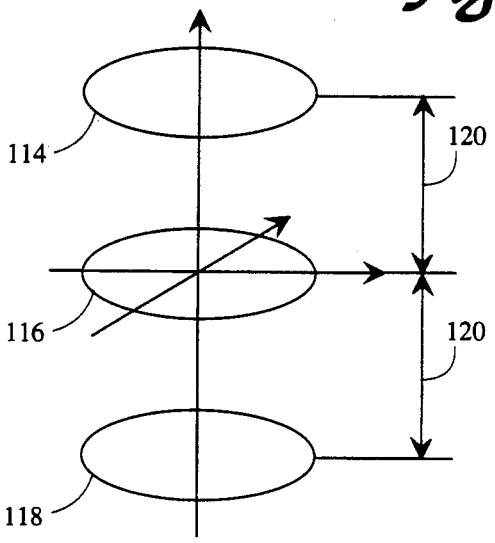
Fig. 8
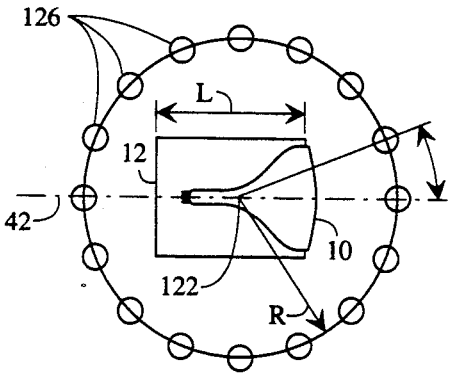
Fig. 9
Fig. 10
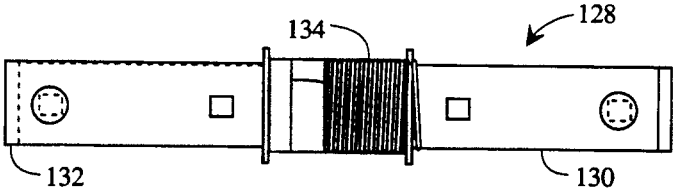
Fig. 11
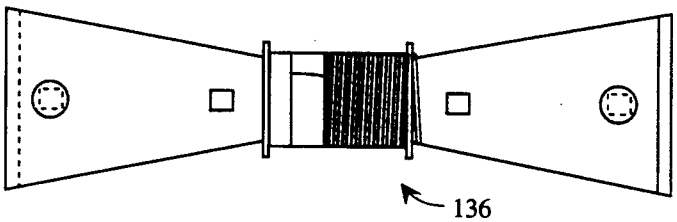
Fig. 12
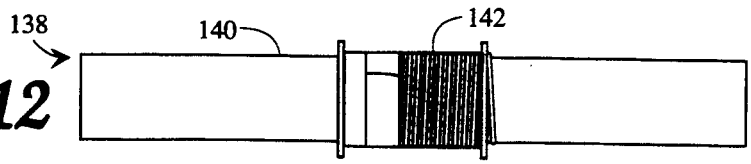

CRT MAGNETIC FIELD CANCELLING DEVICE

BACKGROUND OF THE INVENTION

This invention relates to cathode ray picture tubes, and is addressed to means for abating the low frequency magnetic radiation that emanates from the beam-deflecting yoke of such tubes. More particularly, the limiting is applicable to the very low frequency magnetic radiation of the vertical deflection field of yokes used in high-resolution, single-beam, monochrome visual display terminals (VDT's).

The present invention had its origin in the concern over the possible detrimental effects of the magnetic field component of electromagnetic radiation. Testing for electromagnetic emission in VDT's is described in a booklet published by the National Board for Measurement and Testing (MPR) of Sweden entitled "Test Methods for Visual Display Units: Visual Ergonomics and Emission Characteristics," MPR 1990:8 1990–1991, Boras, Sweden, known as standard MPR-2. Electromagnetic radiation is also a subject of study by the IEEE Working Group P-1140 on a Standard for Measurement of Electromagnetic Near Fields (5 Hz to 30 MHz).

The yoke used in monochrome VDT's is an electromagnetic device that causes a single beam to scan a raster on a CRT viewing screen in the horizontal and vertical directions. Essentially, a yoke consists of two pairs of coils, one deflecting the electron beam in the horizontal direction, and the other in the vertical direction. The two pairs appear as dual radiating magnetic dipoles.

In producing the respective deflecting fields, the coils also produce non-deflecting fields which constitute undesired magnetic fields which radiate beyond the perimeter of the tube and the cabinet in which the tube is enclosed. To cancel the undesired fields, two additional coil pairs have typically been placed in close proximity to the yoke. The additional coil pairs in effect cancel out the flux of the undesired fields and the resulting external radiation. The cancellation achieved however is at the cost of greater circuit complexity and the requirement for additional parts. Also, the magnetic influence of the additional coil pairs can degrade the performance of the yoke.

RELATED ART

In U.S. Pat. No. 4,943,753 to Hevesi, there is disclosed a ring-shaped magnetic shunt for CRT deflection yokes that is disposed on the funnel of the tube between the beam-deflection yoke and the screen. The objective is to reduce the net distributed magnetic radiation in front of and all about the outside of the CRT. The shunt is a substantially complete ring of magnetically permeable material composed of ferrite.

In U.S. Pat. No. 4,709,220 to Sakane et al, a radiation suppression device comprises a coil auxiliary to the yoke and mounted on the yoke by means of wire hangers. The auxiliary coil is wound around the outer face wall of the yoke, and is electrically connected in series or in parallel with the yoke coil. A magnetic field is produced which is said to cancel the undesired radiation of the magnetic field of the deflecting coil in response to a scanning field such as the field produced by the horizontal deflection coil. Because of higher power consumption, a modification of the power supply may be necessary. It is also noted that the German VDE standard cited in the patent (Verband Deutscher Elektrotechniker) with which the '220 device complies is less stringent in its requirements than the Swedish MPR-2 specification met by the stray field cancelling device according to the present invention.

OBJECTS OF THE INVENTION

It is a general object of the invention to provide means for improving the performance of monochrome visual display terminals.

It is another object of the invention to provide means for cancelling non-deflecting fields emanating from beam-deflecting yokes.

It is a further object of the invention to direct a cancelling field into an area that is measured by regulatory agencies.

It is a more specific object of the invention to provide for the cancellation of fields from the vertical deflection coil of a yoke.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

FIG. 7 is a view of the metal plate shown by FIG. 3 with details of the preferred dimensions of the two plates.

FIG. 8 is a schematic depiction of three planes in which magnetic field strength is measured relative to a video display terminal.

FIG. 9 is a schematic view that depicts the points of magnetic field strength measurement on each of the three planes indicated by FIG. 8; and FIGS. 10, 11 and 12 depict other embodiments of a stray field cancelling device according to the invention.

DESCRIPTION OF THE PREFERRED EMBODIMENT

Figure 1:
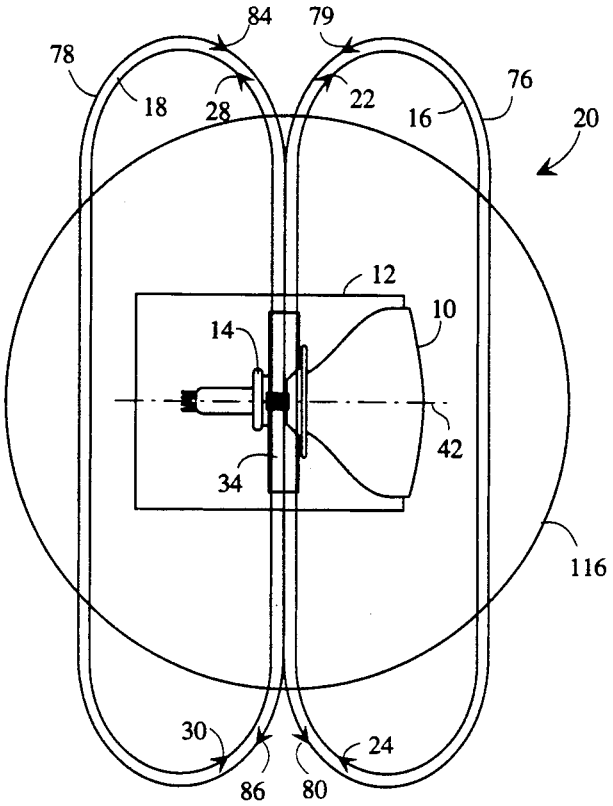
FIG. 1 is a schematic diagram that shows the top of a cathode ray tube on which a yoke is installed, and indicates both the stray magnetic field that emanates from the vertical deflection coil, and the countervailing field emanated by the magnetic field cancelling device according to the invention.

FIG. 1 shows diagrammatically the outline of a cathode ray tube 10 enclosed in a cabinet 12. A yoke 14 that provides for the horizontal and vertical deflection of an electron beam is mounted on the tube 10. The stray magnetic field that emanates from the vertical deflection coil of the yoke 14 is composed of two loops, loop 16 and loop 18, both of which are shown as extending beyond the perimeter of cabinet 12. The clockwise direction of loop 16 as it extends into the frontal area 20 of cabinet 16 is indicated by arrows 22 and 24. The counterclockwise direction of loop 18 as it extends into the rearward area 26 of cabinet 12 is indicated by arrows 28 and 30.

Figure 2:
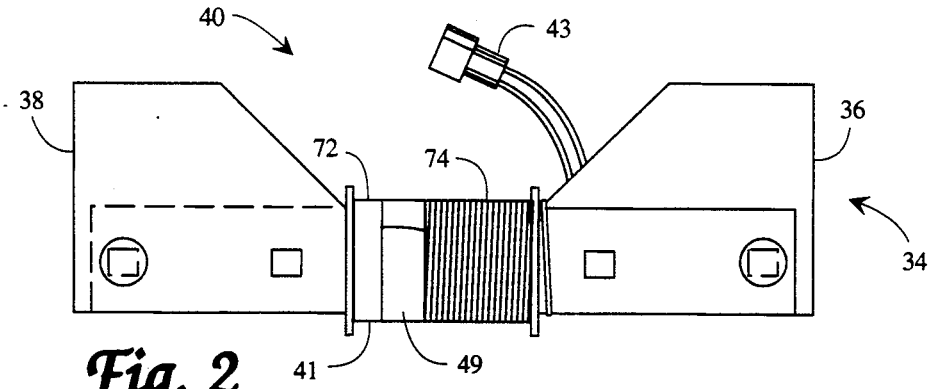
FIG. 2 is a depiction of a preferred embodiment of a stray field cancelling device according to the invention.

A preferred embodiment of a CRT stray field cancelling device 34 according to the invention for abating the stray fields indicated by loops 16 and 18 is depicted in FIG. 2. Device 34 comprises an elongated, substantially rectangular lamination composed of a pair of magnetizable metal plates 36 and 38 having a depressed center section 40 that is enveloped by an electromagnetic coil 41, the details of which will be described infra. The device 34 is located adjacent to the yoke 14, and as indicated by FIG. 1, is oriented transversely to the centerline 42 of cathode ray tube 10. A socket 43 provides for electrical connection of the electro-magnetic coil 41 to the yoke electrical circuit.

Figure 3:
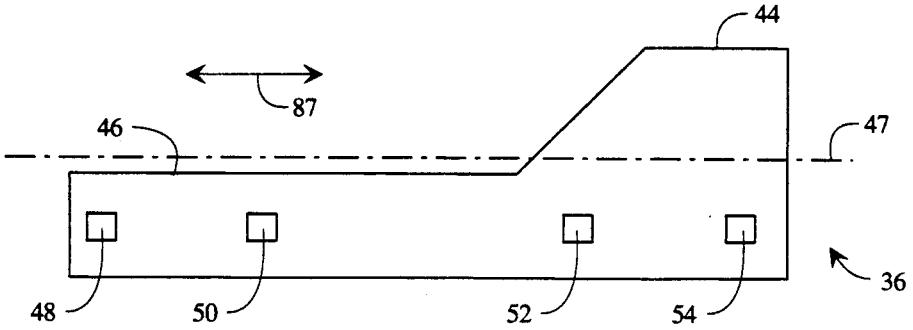
FIG. 3 is a plan view of one of a pair of identical key-shaped metal plates that make up the body of a field cancelling device depicted in FIG. 2.

The configuration of one of the pair of magnetizable metal plates, metal plate 36, that make up the body of the stray field cancelling device is indicated in FIG. 3. Using the terminology of a key which it resembles, metal plate 36 is composed of a bow 44 and a blade 46, with the blade 46 shown as being displaced, in this embodiment, below the centerline 47 of the bow 44 of metal plate 36. As will be described, four rectangular apertures 48, 50, 52 and 54 in metal plate 36 provide for fastening the metal plates 36 and 38 together, a condition indicated by FIG. 4. The dimensions of metal plates 36 and 38 are identical in shape and dimensions.

Figure 3A:
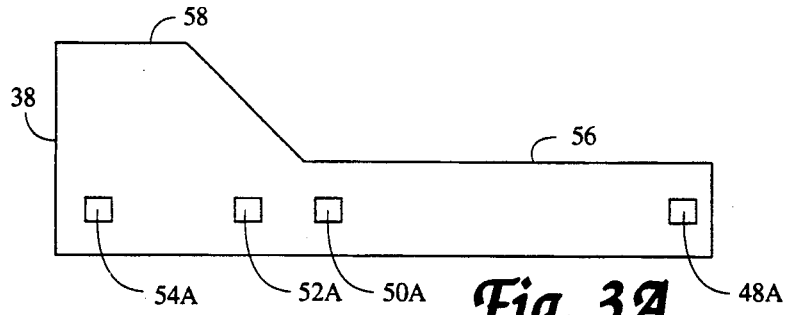
FIG. 3A is view similar to FIG. 3 depicting the second of a pair of identical key-shaped metal plates in opposed relationship to the metal plate shown by FIG. 3.

FIG. 3A depicts a metal plate 38 that is the other of the pair of identical metal plates. Since the metal plate 36 and metal plate 38 are identical, the apertures in metal plate 38 which match the configuration of the apertures in the metal plate 36 are numbered the same except for an "A" suffix; that is, 48A, 50A, 52A and 54A, as indicated in FIG. 3A. This numbering is necessary for an understanding of the function of the apertures in shortening and lengthening the device, as will be described.

Figure 4:
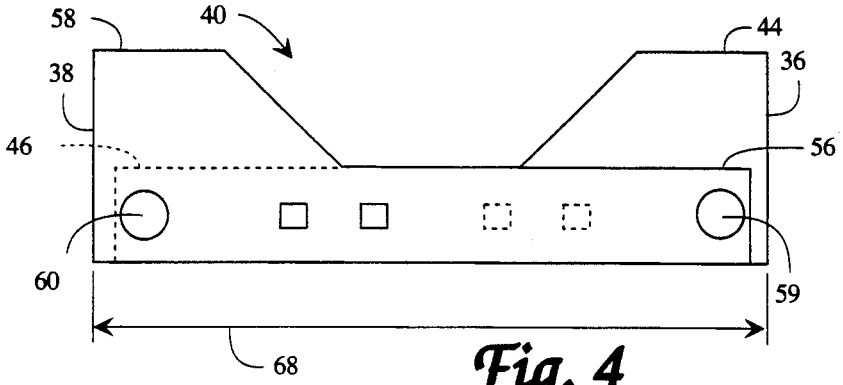
FIG. 4 is a view similar to FIG. 3 in which the plate shown by FIG. 3 is mated with the identical plate shown by FIG. 3A to form the body of a stray field cancelling device.

Blade 46 of metal plate 36 is shown by FIG. 4 as being in facing relationship with blade 56 of metal plate 38, and partially overlapping blade 56 of metal plate 38. The resulting assembly has the shape of an irregular octagon having a central recess 40 that tapers downwardly from the bow 44 of metal plate 36 and the bow 58 of metal plate 38.

The blades 46 and 56 of the respective metal plates 36 and 38 are partially overlapped as shown in FIG. 4 so that rectangular aperture 48 of metal plate 36 and rectangular aperture 54A of metal plate 38 are in alignment, and aperture 48A of metal plate 36 and aperture 48A of metal plate 38 are also in alignment. The two metal plates are conjoined as mirror images in the form of a lamination by the insertion of panel fasteners 59 and 60.

Figure 5:
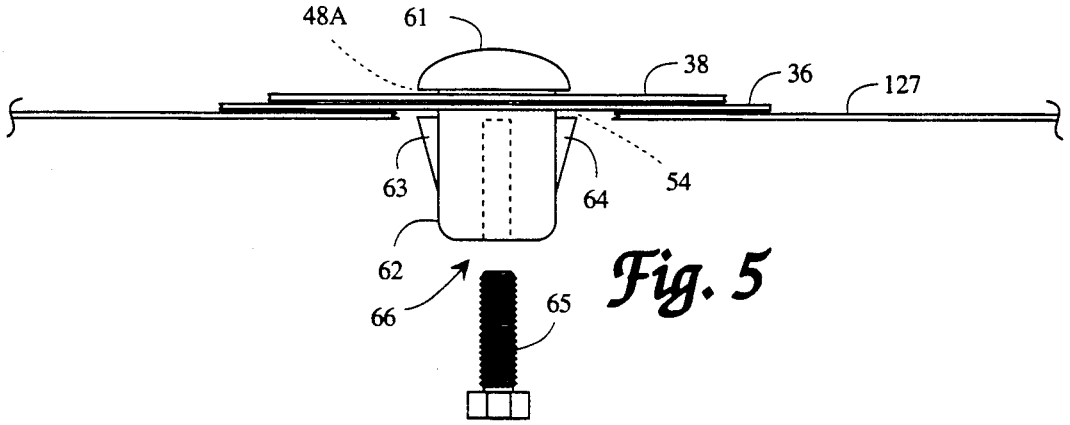
FIG. 5 is an elevational view of a panel fastener used in the assembly of a stray field cancelling device.

A snap-in panel fastener 59, which has a configuration well known in the art, is shown in detail in FIG. 5. Panel fastener 49 has a circular head 61 and a rectangular stem 62 with two flexible tabs 63 and 64 biased outwardly to lock panel fastener 59 in the aligned rectangular apertures 48A and 54. A thread-forming fastener 65, which may be used for mounting the device 34, self-taps into a preformed hole 66 in the material of stem 62. The preformed hole 66 may have an inside diameter of 0.145 inch. Panel fasteners 59 and 60 are preferably made from nylon.

Figure 6:
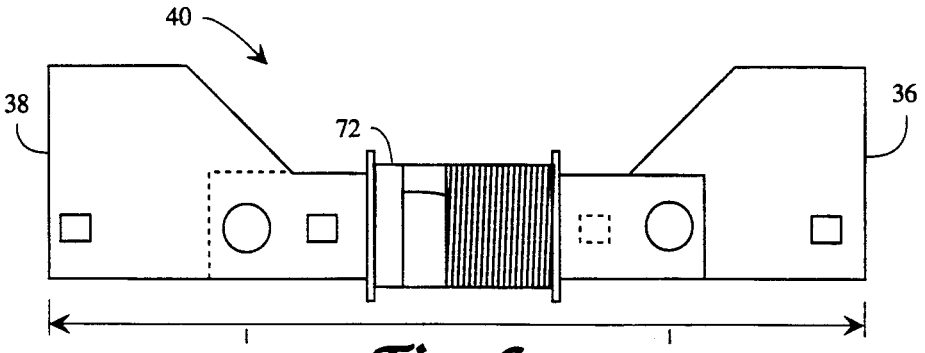
FIG. 6 is a diagrammatic view in which the length of the stray field cancelling device according to the invention is adapted for use with a cathode ray tube of larger diagonal measure than the tube depicted in FIG. 2.

Metal plates 36 and 38 are slidable so that the length of the stray field cancelling device can be adjusted to adapt to cathode ray tubes of different diagonal measure. For example, the configuration depicted in FIG. 4 has length 68 of 8.2 inches for use with tubes of fifteen-inch diagonal measure. In this configuration, aperture 48 of metal plate 36 is in alignment with aperture 54A in metal plate 38, and aperture 48A in metal plate 38 is in alignment with aperture 54 in metal plate 36. The configuration depicted in FIG. 6 provides a length 70 of ten inches for use with tubes of seventeen-inch diagonal measure. In the configuration of FIG. 6, apertures 48 and 52A are aligned, as are apertures 48A and 52, of the respective metal plates 36 and 38. Similarly, a field cancelling device with a length of eleven inches can be assembled by alignment of the apertures 48 and 50A and apertures 48A and 50 to provide a stray field cancelling device for use with tubes of twenty-one inch diagonal measure.

With reference again to FIG. 2, electromagnetic coil 41 is indicated as comprising a bobbin 72 wound with wire 74. By way of example, the gage of the wire is No. twenty-two, and the number of turns in preferably about sixty. The bobbin 72 is preferably made from plastic, and is molded to fit snugly over the blades 46 and 56 so that it can be slid to the center of the recess with slight resistance when the device is lengthened, a condition which is indicated in FIG. 6.

When the electromagnetic coil 41 is electrically energized by the yoke's power supply by connection to socket 43, a magnetic field is generated that is in opposed relationship to the stray field, and in effect, cancels the stray field. This cancellation is indicated diagrammatically in FIG. 1, which depicts the cancelling field in the form of two loops 76 and 78 running in paths opposite to the paths of the stray fields indicated by loops 16 and 18. The stray field represented by loop 16, shown as rotating in a clockwise direction indicated by arrows 22 and 24, is opposed by field cancelling loop 76, indicated by arrows 79 and 80, which indicate that the cancelling field lies in a counterclockwise direction. Similarly, with regard to the stray field indicated by loop 18, it is opposed by the field of cancelling loop 78, indicated by arrows 84 and 86, which indicate that the cancelling field lies in a clockwise direction.

As indicated in FIG. 1, the stray field cancelling device 34 is oriented transversely to centerline 42 of CRT 10 so as to emit a magnetic field out-of-phase and thus in opposed relationship to the fields represented by stray magnetic fields 16 and 18. If however, the stray field cancelling device is rotated 180 degrees end-to-end, an opposite effect will be achieved, and the fields generated by the stray field cancelling device 34 will be in phase with the stray fields 16 and 18 generated by the yoke 14. The effect of this orientation is not the cancellation of stray fields 16 and 18, but an undesired augmentation.

The metal plates 36 and 38 are preferably composed of thick-grained 29M6 silicon steel in which the grain runs lengthwise as indicated by arrow 87 in FIG. 3—a direction which is transverse to the centerline 42 of the cathode ray tube 10 and in the longitudinal plane of the device. The thickness of the metal plates may be, for example, 0.012 inch. The metal plates are preferably sprayed with lacquer to inhibit rusting of the metal.

The dimensions of metal plate 36 are indicated in FIG. 7, and the dimensions cited in the following apply equally to the identical metal plate 38 shown by FIG. 3A. The overall length 88 is 8.00 inches and the height 90 of the bow 44 is 2.530 inches. The length 92 of blade 46 is 5.0 inches and its height 94 is 1.160 inches. The taper 96 from bow 44 to the blade 46 is an angle of forty-five degrees. Each of the rectangular apertures 48, 50, 52 and 54 is 0.0343 inch wide and 0.250 inch high. The spacing 98 between apertures 48 and 50 is 4.313 inches, the spacing 100 between apertures 50 and 52 is 1.00 inch, the spacing 102 between apertures 52 and 54 is 0.544 inch, and the spacing 103 between apertures 50 and 54 is 2.800 inches. The distance 104 between the centerline 106 of the apertures 48, 50, 52 and 54 and the base 108 of blade 46 is 0.580 inch. The distance 110 between the center of aperture 54 and edge 112 of the bow 44 is 0.544 inch.

Further with regard to the electromagnetic coil 41, and with reference to FIG. 2, again by way of example, the 60 turns of wire are wound side-by-side, with no overlap, and with counterclockwise rotation of the bobbin during winding, which provides for a clockwise winding of the wire. A layer of elastic tape 49 provides for retention of the winding. The winding terminates in a connector 43 which provides for an electrical connection in series with the vertical winding of the yoke. The voltage through the device is in the range of 50 to 100 millivolts, the peak deflection current from 100 to 500 milliamperes, and the total power consumption is about 0.1 watt. It is noted that the frequency of the vertical oscillator that controls beam deflection is in the range of 60 Hertz to 80 Hertz, with the 80 Hertz frequency preferred as the higher refresh rate reduces flicker of the image and consequent eyestrain.

The pattern of field strength measurement may be described as a cylindrical coordinate system. FIG. 8 is a three-dimensional view of the three planes of the system along which the field emitted by the CRT vertical deflection coil is measured: a top plane 114, a middle plane 116 (also shown by FIG. 1) and a bottom plane 118. The distance 120 between the planes is 0.3 meter.

The origin of the cylinder coordinate measurement system lies at the center 122 of the monitor cabinet 12, as indicated by FIG. 9. The origin—at center 122—is in coincidence with the horizontal centerline 42 of the cathode ray tube 10. The distance R, or radius, in meters between the center 122 of the cabinet 12 and the perimeter of the planes is determined by the formula $R=L/2+0.5m$, where L is the front-to-back dimension of the cabinet 12.

FIG. 9 also depicts the points of measurement 126 of magnetic field strength on each of the three planes 114, 116 and 118. Measurements on each plane are taken every 22.5 degrees. As 16 measurements are taken for each plane, the total number of measuring points 126 is 48.

Without the magnetic field cancelling device according to the invention, the range of peak intensities from monitor to monitor is 400 to 700 nT (nanoTesla), and the range at the 16 measurement points on each plane is 100 to 600 nT. Upon installation of the magnetic field cancelling device according o the invention, the range is 100 to 150 nT, which is well below the Swedish MPR-2 standard, which specifies a maximum of 250 nT.

The strength of a magnetic field must be determined by means of a meter capable of measuring extremely low frequency magnetic fields (ELF); that is, fields in the frequency range of 5 Hz to 2,000 Hz. The measurement cycle includes measurement of magnetic field strength, frequency and polarization. A suitable instrument is Magnetic Field Meter 10 manufactured by Combinova AB, Bromma, Sweden. The United States representative of this company is Ergonomics, Inc., Southhampton, Pa.

With regard to the mounting of the stray field cancelling device, it it is preferably located directly above the yoke a distance in the range of three to six inches, with the exact distance determined by the amount of stray field cancelling desired. The device may be suspended from the top of the cabinet or from any convenient bracket by means of the panel fasteners 59 and 60, using fasteners such as thread-forming fastener 65 shown in FIG. 5. Additional panel fasteners may be inserted in the other apertures to provide overall support of the device.

It is noted that the recess 40 provides clearance for adjustments to the yoke when it is necessary to locate a stray field cancelling device very close to the yoke.

While the configuration shown by FIG. 2 is a preferred embodiment, as depicted in FIG. 10, alternatively, the device may be in the form of an elongated rectangle, as indicated by stray field cancelling 128 depicted in FIG. 10. As with the configuration of the device 34 shown by FIG. 2, device 128 comprises a lamination composed of magnetizable metal plates 130 and 132 enveloped by a magnetic coil 1 34. Similarly, a stray field cancelling device may have the shape of a bow tie, as depicted by device 136 depicted in FIG. 11.

Furthermore, to increase the inductance of the stray field cancelling device, and/or to reduce the size of the device, additional plates may be added to the lamination formed by metal plate 34 and metal plate 36. The utilization of more than two plates is indicated schematically in FIG. 5 by the presence of a third metal plate 127. An advantage of one or more additional plates is that the over-all size of the device can be reduced because of the greater cancellation effect achieved.

In the same spirit, if only a minimum of stray field cancellation is desired, the device may be constructed with only a single metal plate enveloped by a magnetic coil. A stray field cancelling device 138 is depicted in FIG. 12, and is indicated as having only one metal plate 140 enveloped by a magnetic coil 142. As metal plate 140 is not to be formed into a lamination with another plate, no push-fasteners such as push fastener 59 shown by FIG. 5, are required. However, it may be expedient to install them, as they can facilitate the mounting of the device 138.

The benefits of the invention include

1. A simplification in the design of stray field cancelling devices in that only a single magnetic coil is used.

2. The field cancelling device directs the cancelling field into an area that is measured by regulatory agencies.

3. By cancelling stray yoke fields away from the yoke, interaction between the stray field cancelling device and the yoke is minimized; the amount of interaction is on the order of two percent.

4. The device is not physically connected to the yoke nor supported by it.

5. The effectiveness of the device is such that there is no need for auxiliary magnetic shielding. Shielding of this type is usually built into the cabinet with consequent penalties in the form of additional weight, design complexity problems with heat removal, and additional cost.

6. No modification of the yoke circuit or the power supply is necessary because of the very low power consumption of the device.

7. A simple physical modification makes the device adaptable to different CRT sizes and requirements.

8. The simplicity of design makes for easy and economical manufacture and installation.

While a particular embodiment of the invention has been shown and described, it will be readily apparent to those skilled in the art that changes and modifications may be made in the inventive means without departing from the invention in its broader aspects, and therefore, the aim of the appended claims is to cover all such changes and modifications as fall within the true spirit and scope of the invention.

I claim:

1. A CRT stray field cancelling device for abating a stray magnetic field emanating from a vertical deflection coil of a yoke, the device comprising an elongated member of adjustable length composed of at least two magnetizable metal plates in slidable relationship enveloped by an electromagnetic coil, the device being physically isolated from the yoke a distance effective to exert minimum effect on the yoke deflection fields, and oriented transversely to the centerline of a CRT so as to generate a cancelling magnetic field in opposed relationship with, and transverse to, the stray magnetic field.

2. The CRT stray field cancelling device according to claim 1 wherein the electromagnetic coil comprises a bobbin wound with about 60 turns of No. 22 wire.

3. The CRT stray field cancelling device according to claim 2 wherein the bobbin is slidable on the metal plate.

4. The CRT stray field cancelling device according to claim 1 wherein the metal plate is composed of silicon steel.

5. The CRT stray field cancelling device according to claim 4 wherein the silicon steel is thick-grained and the grain is oriented in the longitudinal plane of the device.

6. The CRT stray field cancelling device according to claim 1 further constructed and located such that the device includes means for directing the magnetic field into a measurement area.

7. The CRT stray field cancelling device according to claim 1 including means for shortening or lengthening the device to adapt it to the size of the CRT with which it is used.

8. The CRT stray field cancelling device according to claim 1 wherein the device has an inductance in the range of 600 uH to 650 uH.

9. The CRT stray field cancelling device according to claim 1 wherein the device is spaced from the yoke a distance in the range of three to six inches.

10. The stray field cancelling device according to claim 1 wherein the device has the shape of a bow tie.

11. A CRT stray field cancelling device for abating a stray magnetic field emanating from the vertical deflection coil of a CRT yoke, the device comprising a lamination composed of a pair of key-shaped, magnetizable metal plates, the blades of which are in facing relationship and overlap to form the device into an irregular octagon having a central recess tapering from the bows of the key-shaped magnetizable metal plates for receiving an electromagnetic coil.

12. The CRT stray field cancelling device according to claim 11 wherein the device is physically isolated from the yoke and oriented transversely to the centerline of a CRT so as to generate a cancelling magnetic field in opposed relationship to, and out of phase with, the stray magnetic field.

13. A monochrome monitor housed in a cabinet and including a cathode ray tube having a yoke with a vertical deflection coil that radiates a stray magnetic field outside the cabinet, a stray field cancelling device comprising an elongated, substantially rectangular lamination composed of a pair of magnetizable metal plates having a depressed center section enveloped by an electromagnetic coil for generating a magnetic field cancelling the stray magnetic field, the device being physically isolated from the yoke and oriented transversely to the centerline of the cathode ray tube so as to generate a cancelling magnetic field in opposed relationship to, and out of phase with, the stray magnetic field.

14. The CRT stray field cancelling device according to claim 13 wherein the electromagnetic coil comprises a bobbin. wound with about 60 turns of No. 22 wire.

15. The CRT stray field cancelling device according to claim 14 including means for shortening or lengthening the device to adapt it to the size of the CRT with which it is used.

16. The CRT stray field cancelling device according to claim 13 wherein the metal plates are composed of silicon steel.

17. The CRT stray field cancelling device according to claim 13 wherein the silicon steel is thick-grained and the grain is oriented in the longitudinal plane of the device.

18. The CRT stray field cancelling device according to claim 13 wherein the device has the shape of a bow tie.

* * * * *